US005791462A

United States Patent [19]

Whitnell

[11] Patent Number: 5,791,462

[45] Date of Patent: Aug. 11, 1998

[54] CUP CARRIER

[75] Inventor: Simon Whitnell, Exton, Pa.

[73] Assignee: Dopaco, Inc., Exton, Pa.

[21] Appl. No.: 719,648

[22] Filed: Sep. 25, 1996

[51] Int. Cl.[6] ..... B65D 75/00

[52] U.S. Cl. ..... 206/144; 206/180; 206/504

[58] Field of Search ..... 206/144, 193, 206/162, 427, 504, 175, 180, 188

[56] References Cited

U.S. PATENT DOCUMENTS

| | | | |
|---|---|---|---|
| 2,418,350 | 4/1947 | Holy | 206/176 |
| 3,306,485 | 2/1967 | Wood | 206/188 |
| 4,378,880 | 4/1983 | Summers | 206/175 |
| 4,396,116 | 8/1983 | Stone | 206/175 |
| 5,069,335 | 12/1991 | Beales | 206/180 |
| 5,221,001 | 6/1993 | Eisman . | |
| 5,518,110 | 5/1996 | Harrelson | 206/139 |

*Primary Examiner*—Paul T. Sewell
*Assistant Examiner*—Nhan T. Lam
*Attorney, Agent, or Firm*—Dennison, Meserole, Pollack & Scheiner

[57] ABSTRACT

A carton blank formed utilizing a pattern layout with adjacent blanks nesting with each other to minimize the material required and reduce waste between adjacent blanks. The formed carton is a modular carrier with a central hand grip opening and a peripheral wall with a pair of reduced height corner portions, and is adapted to lock to a laterally adjacent duplicate carrier.

12 Claims, 2 Drawing Sheets

CUP CARRIER

BACKGROUND OF THE INVENTION

The invention broadly relates to modular cup carriers formed from unitary blanks of paperboard and consisting basically of a basket portion with a central upwardly projecting handle forming dual compartments for the accommodation of, as an example, two beverage cups.

An example of such a carrier will be noted in U.S. Pat. No. 5,221,001 issued to Larry Eisman on Jun. 22, 1993, and commonly assigned with the present application. As will be noted in this patent, carriers of the general type involved herein are particularly adapted for assembly with a transversely positioned duplicate carrier to provide a "four pack" carrier readily carried by one hand.

Such known carriers, because of the rectangular nature of the basket portion and the projecting side panels and handles, require the use of a substantial amount of material in defining the blank. The formation of such blanks is usually effected by the cutting a plurality of blanks, either sequentially or simultaneously, depending on the cutting apparatus, from an elongate sheet of appropriate flexible foldable material, normally paperboard.

As carriers or cartons of the type involved herein are normally single use items, it is particularly desirable to maintain the cost thereof at a minimum while providing the convenience and practical considerations for which the particular carrier has been designed. Further, as such carriers are produced in vast numbers, it will be appreciated that even small economies in the production of the blanks from which the cartons are folded can result in substantial savings. However, in light of the configuration of the conventional two-cup carrier, as compared for example to a conventional rectangular blank for a rectangular box, and as the cup carrier has specific structural and design parameters, it is normally difficult to provide for a maximum utilization of the blank material.

SUMMARY OF THE INVENTION

It is a principal object of the present invention to minimize the amount of material required in the formation of a modular two-cup carrier, while retaining the overall configuration of a conventional carrier and incorporating all of the desirable features thereof.

In addition, and with regard to the assembled carrier itself, it is also a significant object of the invention to incorporate features which enhance the practicality of the basic carrier both by facilitating the carrying or handling thereof, and by increasing the accessibility to the containers, bottles or the like received therein. This is achieved without compromising the strength or structural stability desired in such carriers.

The enhanced features of the assembled carrier, and the desired savings in material are both achieved by a unique blank configuration and a cutting layout of internesting patterns for the cutting of the blanks from an elongate sheet or roll of material.

Basically, the blank two side walls and two end walls are foldable along appropriate fold lines to define a rectangular basket or basket portion for the carrier. The walls include a substantially linear upper edge and a substantially linear lower edge with integral projecting bottom-forming flaps. The linear upper edge includes two recesses therein, each recess extending along a major portion of one of the end walls and for a minor portion of an adjacent side wall. The side walls, in turn, each have a side panel integral therewith and extending upward therefrom with a laterally adjacent handle panel terminating in a hand grip portion of the same configuration and dimension as one of the recesses. In forming the blanks from a solid sheet of material, the blanks, or patterns therefor, are each inverted relative to the next adjacent blank with the hand grip portions of each blank nested within the recesses of an adjacent blank, thus in effect compacting the blanks relative to each other and allowing for the formation of more blanks per running length of the sheet of material. While the broad concept of internesting blank patterns is known, the present invention uniquely incorporates this concept in the formation of a two-cup carrier in a manner which achieves the desired savings in material and enhances the practicability of the carrier itself.

The features and advantages of the invention will become more apparent from the detailed description of the invention following hereinafter.

DESCRIPTION OF PREFERRED EMBODIMENT

The modular carrier 10 is folded from a single blank 12 of appropriate sheet material preferably paperboard. Noting FIG. 3, it will be seen that, utilizing appropriate manufacturing procedures, multiple blanks 12 are produced or cut from an elongate sheet of material with the cutting layout of the invention being such as to achieve maximum utilization of the sheet while at the same time producing a finished carton 10 including not only all of the desirable attributes of the prior art two-cup cartons, but also providing for positive improvements in such cartons. Inasmuch as the carton or carrier 10 is formed directly from the blank 12, the same portions in the blank and the carrier will carry the same name and numerical designation.

Figure 2:
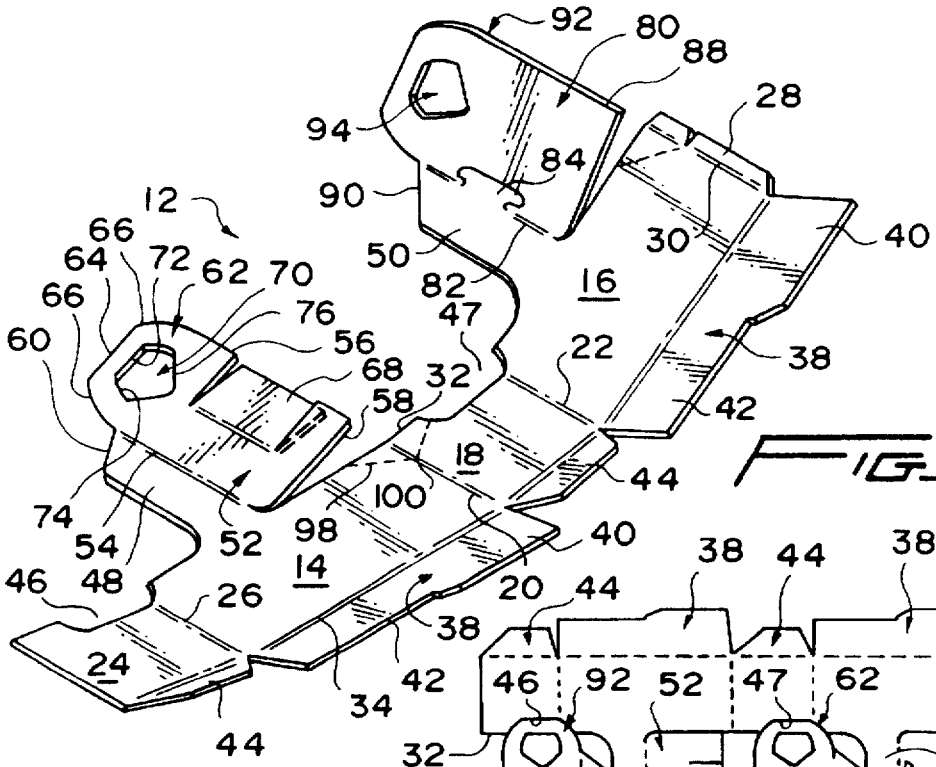
FIG. 2 is a perspective view of a single blank partially folded to emphasize both the fold lines and the manner of folding.
Figure 3:
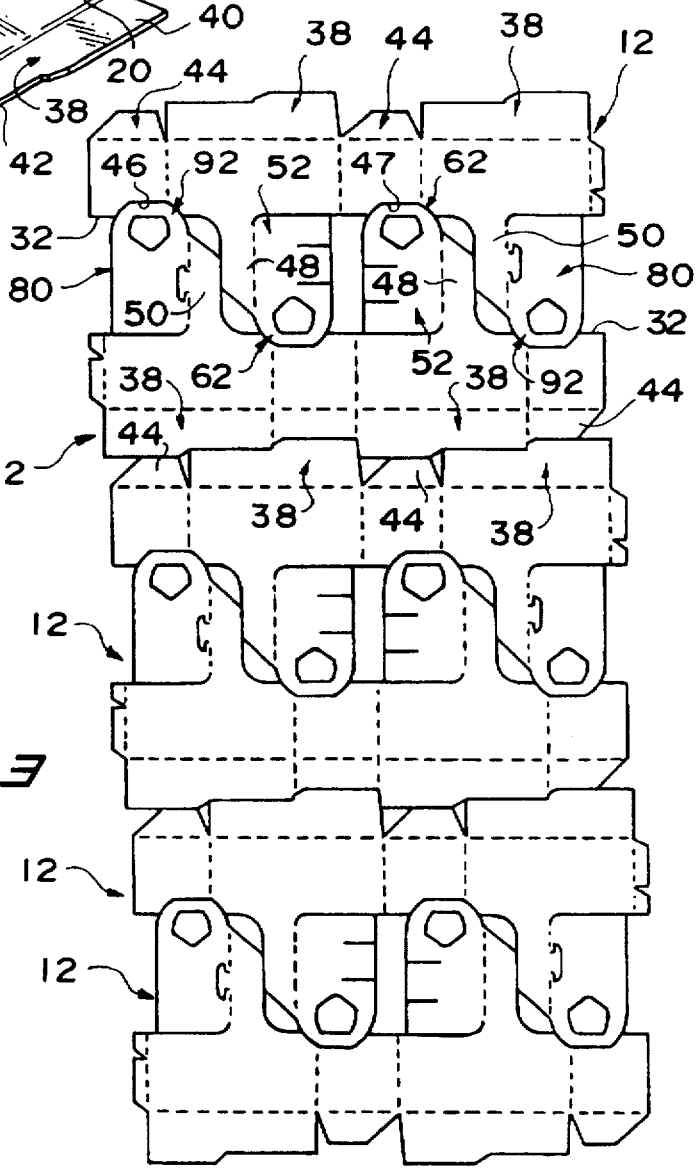
FIG. 3 is a plan view of blanks or blank patterns arranged in the nested relationship of the invention.

Attention is first directed to the blank 12, illustrated in FIG. 2 at the initial stage of folding, and in FIG. 3 in plan view with multiple duplicate blanks or blank patterns. The blank 12 includes first and second side walls 14 and 16 of equal length and of substantially rectangular configuration. A first intermediate end wall 18 is interposed between and integral with inner side edges 20 and 22 of the side walls 14 and 16 respectively. This joinder between the first end wall 18 and the side walls 14 and 16 define fold lines similarly referred to by numerals 20 and 22. A second end wall 24 is integral with the first side wall 14 along fold line 26 which defines the outer side edge of this wall 14. An appropriate glue flap or flaps 28 are integral with the outer edge of the second side wall 16 along fold line 30.

The side and end walls have aligned upper edges defining, in the blank 12, linear upper edge 32. A similar linear or straight lower edge 34 is defined by the individual lower edges of the side and end walls. Integral with the portion of this linear lower edge coextensive with each side wall 14 and 16 is an elongate bottom flap 38 having a stepped outer edge to define, in each flap 38, a first section 40 which is longitudinally shorter than, and transversely wider than, the remaining longitudinal section 42. Similar, outward extending bottom flaps 44 are integral with and foldable relative to the lower edges of the end walls 18 and 24. These flaps 38 and 44 appropriately internest upon the folding of the blank into the carton 10.

Incidentally, it is to be appreciated that for purposes of illustration and description, the edges are referred to as they appear in an erected carton or carrier 10. In other words, the edge 32 is the upper edge, while the edge 34 is the lower edge. The fold lines or edges between the adjacent walls, such edges extending between the upper and lower edges 32 and 34, are vertical edges. The remaining components are related thereto, as for example, the bottom flaps 38 and 44.

The linear upper edge 32 of the side and end walls includes a pair of elongate recesses 46 and 47 defined therein. These recesses are dimensionally equal and preferably include a flat inner edge with opposed arcuate sides. The recess 46 extends along a major portion of the second end wall 24, beyond the fold line 26, and for a minor extent along the adjacent side wall 14, that portion of the recess 46 extending into the side wall 14 generally corresponding to the arcuate side edge of the recess.

The recess 47, similarly, extends along a major portion of the first intermediate end wall 18 and, beyond the fold line 22, for a minor portion of the length of the side wall 16, this side wall distance generally corresponding to the arced end of the corresponding recess 47.

First and second side panels 48 and 50 respectfully extend upward from the upper edge 32 at an intermediate point along the side walls 14 and 16 longitudinally offset from the corresponding recesses 46 and 47. The side panels 48 and 50 are coplanar and rigid extensions of the side walls 14 and 16, that is no fold line is defined therebetween. A first handle panel 52 is integral with a lateral side edge of the side panel 48 defined by fold line 54 and has a parallel free outer edge 56 located just inward of a line defined by the fold line 20 between the side wall 14 and intermediate end wall 18. The lower edge 58 of the handle panel 52 is a free edge defined from the longitudinal upper edge 32 by a single cut line, allowing for a folding of the handle panel 52 about the fold line 54 to a position at right angles to the side panel 48 as illustrated in the carton 10 of FIG. 1. The handle panel 52 extends above the upper edge 60 of the corresponding side panel 48 and defines a hand grip portion 62 with a flat upper edge 64 and rounded corner portions 66. The configuration of the outer end of the hand grip portion 62 corresponds to that of the recess 47, providing for a nested engagement of the hand grip portion 62 of one blank into the recess 47 of an adjacent blank rotated at 180° to the first blank. This will be apparent from the pattern layout of FIG. 3. The upward extension of the hand grip portion 62 relative to the side panel 48 is basically achieved by utilizing side panels slightly shorter than those of the earlier carrier noted in the above cited U.S. Pat. No. 5,221,001. This reduction in the height of the side panel 48 allows for the desired nesting relationship, as shall be explained in more detail subsequently, without any weakening in the strength of the carrier. It will also be noted that the upper edge 60 of the first side panel 48 is inclined downward and outward relative to the hand grip portion 62, thus eliminating additional material thereabove which adds little or nothing to the structural integrity of the erected carton.

The first handle panel 52 also includes a locking flap 68 defined by upper and lower spaced parallel cut lines extending inward from the free outer edge 56 for a resilient flexible movement of the flap 68 as a securing means upon the joining of adjacent cartons to each other.

Figure 1:
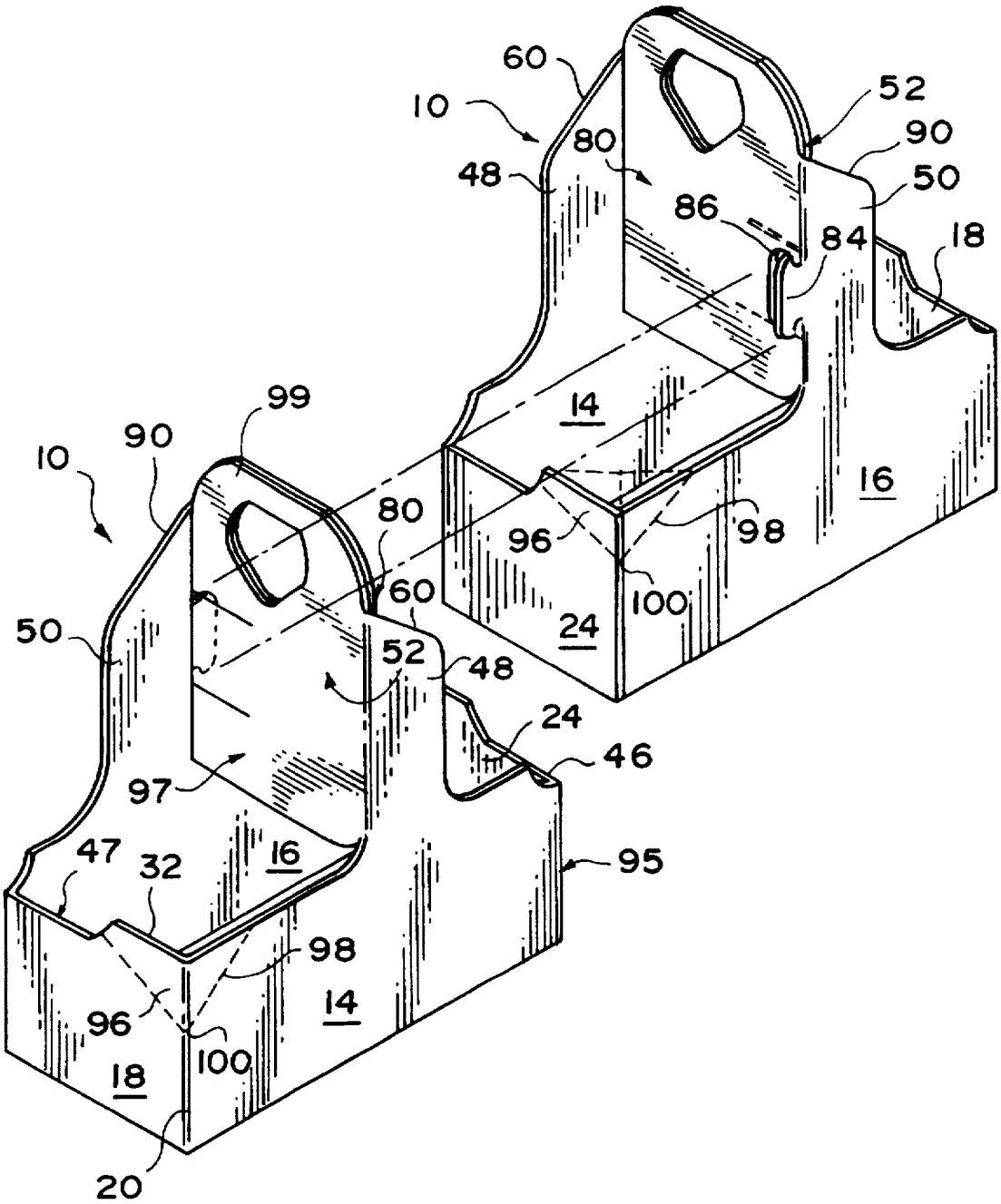
FIG. 1 is a perspective view illustrating two carriers, aligned for assembly, incorporating the features of the invention and defined from the blank of the invention.

The hand grip portion 62 includes a central opening 70 therethrough for the accommodation of fingers for the carrying of the carton 10, and preferably two joined cartons as suggested in FIG. 1. The opening 70 includes an upper edge 72 and opposed side edges 74 generally parallel respectively to the hand grip upper edge 64 and corner portions 66 in generally equally spaced relation thereto. As such the upper portion of the opening is of a substantially constant width. The lower portion of the opening is defined by a pair of downwardly conveying edges 76. The opening thus formed provides a wide upper edge 72 against which the fingers can engage, and a progressively narrower lower portion which simplifies introduction of the fingers to the opening without weakening the handle panel as would be the case were the opening of full width for the full height thereof.

A second handle panel 80, is integral with a lateral side edge of the side panel 50 defined by fold line 82. At approximately mid-height along the fold line 82, the handle panel 80 has a latch lug 84 formed therein by an appropriate cut line whereby, upon a folding of the handle panel 80 relative to the side panel 50, the latch lug 84 will project coplanar from the side panel 50 and will in turn define a latch aperture 86 in the handle 80. This relationship will be noted in the uppermost carton 10 in FIG. 1.

The second handle panel 80 has an outer free edge 88 parallel to the fold line 82 and located just inward of vertical alignment with the outer fold line 30 on the second side wall 16.

The lower edge of the handle panel 80 is a free edge, defined from the longitudinal upper edge 32 by a single cut line, allowing for a folding of the handle panel 80 about the fold line 82 to a position at right angles to the side panel 50 as illustrated in FIG. 1 to overly the handle panel 52 in intimate engagement therewith and to align the latch aperture 86 with the locking flap 68 for the accommodation and locking retention of the latch lug 84 of an adjacent carton upon a sliding engagement of the two cartons 10 with each other.

The second handle panel 80 extends above the upper edge 90 of the corresponding side panel 50 and defines a hand grip portion 92 which duplicates the hand grip portion 62 and is configured to nest within the recess 46 of an adjacent blank 12 rotated 180° to the first blank 12, as will be apparent from the pattern layout of FIG. 3. The upward extension of the hand grip portion 92 relative to the corresponding side panel 50 allows for the desired nesting of the hand grip portion 92 within the recess 46. At the same time, the formation of the side panel 50 at less than the total height of the handle panel 80 does not affect the strength of the carrier. It will also be noted that the upper edge 90 of the second side panel 50 is inclined downward and outward relative to the hand grip portion 92 from an upper point generally aligned with the hand grip opening 94 which duplicates the opening 70 in the first hand grip portion 62. With the upper edge 90, as well as the previously described upper edge 60, being formed at such an angle or inclination, the load forces generated in the side panels are generally directly transferred to the hand grip portions for greater strength and stability.

Referring now more particularly to the cutting layout of FIG. 3 which, for purposes of illustration and explanation, has been illustrated as a series of blank patterns or blanks prior to release from the sheet and the removal of scrap portions of the sheet, it will be seen that the blanks or blank patterns are arranged into first and second series. The blanks of the first series are orientated in the same direction. The blanks in the second series are rotated 180° relative to and interposed between the blanks in the second series. In other words, adjacent blanks are positioned at 180° to each other whereby the hand grip portions 62 and 92 of one blank nest within the recesses 47 and 46 of an adjacent blank and thus minimize the space in between blanks and the material required for the formation of the adjacent blanks. In turn, one of the blanks just described will have the lower edges thereof, defined by the bottom flaps, engaging the lower edges of a second adjacent blank, again rotated 180° thereto, with the adjacent lower edges having the various offsets therein mating with each other whereby in effect a single transverse cut line will define the two sets of lower edges.

As a further explanation, and with reference to the two top blanks in FIG. 3, the upper blank is rotated, in the plane of the blank, 180° relative to the blank immediately therebelow. It will be seen that a single cut line defines the upper (now inverted) edge 32, and corresponding recesses 46 and 47, and the upper portions of the hand grip portions 62 and 92 of the blank immediately therebelow. Similarly, it will be seen that the side panels 48 and 50 of these two blanks are in lateral abutment with each other and defined by single vertical cut lines. The upper edge 32 of the lower of the two blanks similarly is defined by a linear cut line which also defines the hand grip portions 62 and 92 of the upper blank.

With the above layout, it is intended that the use of material be maximized, allowing for the production of more cartons per dollar based on the reduced amount of sheet material required. This is achieved to a large part by reducing the handle area of the carton and providing for a nesting effect of the blanks or blank patterns on the die cut layout. There is no adverse effect on the strength or structural integrity of the carton, and at the same time features are added which enhance the appearance and practicability of the carton.

With specific reference to the modular carton 10 formed from the blank 12, it will be seen that the cartons, while capable of individual use as a two container carrier, can also be used in pairs with the hand grips adjacent each other and easily grasped by a single hand. Each carton includes a two compartment basket 95 and a central handle comprising the side panels 48 and 50, a handle wall 97 and an upper hand grip section 99. Each hand grip opening, the overlaid openings 70 and 94, aligns centrally within the corresponding handle wall 97 with the load balanced to each side thereof. This is a distinct improvement over prior art cartons wherein the handle opening is immediately adjacent one of the side panels or side walls of the carton.

The relatively lower portion of each basket compartment, one to each side of the central handle and at diametrically opposed outer corners, is defined by the recesses 46 and 47 and facilitates the insertion and removal of goods from the individual pockets compartments. These recess portions also expose a greater portion of the goods for ready identification. While this may be of limited benefit with regard to tall cups or bottles, it will be of significant practical value for shorter cups and/or food containers for which the carton is equally adapted. These reduced height portions do not affect the structural stability of the carton in that the basket portion of the carton is at full height for a substantial portion of the walls of each basket compartment.

As an additional feature of the formed carton, it is proposed that the upper portion of the full height outer corner of each basket compartment, as at 96, be inwardly foldable to selectively project laterally and at a diagonal into the interior of the compartment should this be necessary for stabilization of the contents. As will be appreciated from the drawings, this folding upper corner portion 96 is defined by a pair of fold lines 98 angling upward and outward, from a common point 100 below the upper edge 32 across the adjoining corresponding side wall 14, 16 and end wall 18, 24 and terminating at the upper extremities of the corresponding walls substantially equal distance from the corner to allow for an inward folding of the two substantially triangular shaped corner portions defined therefrom.

The foregoing illustrates the features of the invention, with the scope of the invention being defined in the claims following hereinafter.

I claim:

1. A material reduction blank for use in the formation of a modular cup carrier usable individually and adapted to selectively engage with a duplicate carrier; said blank comprising first and second side walls, each side wall having an inner side edge and an outer side edge, a first end wall between and integral with the inner side edges of said side walls, a second end wall integral with said outer side edge of said first side wall, said side and end walls having a common linear upper edge and a common linear lower edge substantially parallel to upper edge; said upper edge, for a portion of said first end wall and an adjacent portion of said second side wall, being offset downwardly toward said lower edge and defining a first elongate recess of predetermined configuration, said upper edge, for a portion of said second end wall and an adjacent portion of said first side wall, being offset downwardly toward said lower edge and defining a second elongate recess of predetermined configuration, first and second side panels respectively integral with said first and second side walls along said upper edge and longitudinally offset from said recesses, said side panels each extending upward relative to said upper edge, a separate handle panel with an upper hand-grip portion of a predetermined configuration extending from each side panel, the configuration of said hand-grip portion of said first side panel corresponding to the configuration of said first recess, and the configuration of said hand-grip portion of said second side panel corresponding to the configuration of said second recess, wherein, in a cutting layout for cutting blanks from a sheet of material, a nested relationship is achieved between adjacent blanks, one inverted relative to the other, with the hand-grip portions and corresponding recesses providing a compact nesting of said adjacent blanks and a maximum utilization of the sheet of material.

2. The blank of claim 1 wherein each side panel has a side edge extending substantially perpendicular to said upper edge and extending to a predetermined height, each handle panel extending upward from said upper edge and being integral with the side edge of the corresponding side panel for said predetermined height, each said hand-grip portion extending above the corresponding side panel.

3. The blank of claim 2 wherein each handle panel has a free outer edge parallel to the side edge of the corresponding side panel, and each handle panel having a free lower edge parallel to said upper edge of said side and end walls.

4. The blank of claim 3 wherein each of said side panels has an upper edge, a finger opening defined in each handle panel centrally between the free edge thereof and the side edge of the corresponding side panel, and a fold line defined along each of said side panel side edges for a folding of the corresponding handle panel relative to the side panel.

5. The blank of claim 4 wherein said hand-grip portion of each handle panel has at least a major portion thereof extending above the upper edge of the corresponding side panel.

6. The blank of claim 5 wherein the upper edge of each side panel is inclined downward and laterally outward from the hand-grip portion of the corresponding handle panel.

7. The blank of claim 6 wherein said finger opening of each handle panel is defined primarily in said hand-grip portion and includes a straight upper edge extending on a line transversely between said corresponding handle panel free outer edge and side panel side edge, said opening, for a predetermined portion of the height thereof downward from the opening upper edge, being of a substantial constant width, said opening including a communicating lower portion defined by converging edges.

8. The blank of claim 7 wherein said first elongate recess extends for a major portion of said first end wall and a minor portion of said second side wall, and said second elongate recess extends for a major portion of said second end wall and a minor portion of said first side wall.

9. The blank of claim 1 wherein said first elongate recess extends for a major portion of said first end wall and a minor portion of said second side wall, and said second elongate recess extends for a major portion of said second end wall and a minor portion of said first side wall.

10. A material reduction layout for the forming of blanks from a sheet of flexible material, said layout including at least one pair of adjacent first and second blank patterns on said sheet of material with said second pattern rotated 180° to said first pattern in the plane of the sheet, said patterns having duplicate longitudinal adjacent edges thereon, said edges each including a pair of longitudinally spaced equally dimensioned and configured recesses and a pair of longitudinally spaced projecting portions, the projecting portions of the longitudinal edge of each blank pattern being configured and dimensioned to conform to, and be received within the recesses of the longitudinal edge of the other blank pattern, and a single line defining each recess and the projecting portion received therein, said blank patterns also having opposed transverse edges, said recesses and said projecting portions each being in inwardly spaced relation to said transverse edges.

11. The layout of claim 10 wherein each blank pattern has transverse fold lines therein dividing the blank pattern into two elongate side walls and two adjacent narrower end walls, said end walls alternating with said side walls, each of said recesses being defined in both a side wall and an adjacent end wall.

12. The layout of claim 11 wherein each projecting portion extends solely from a side wall.

* * * * *